US009834336B1

(12) United States Patent
Bowen

(10) Patent No.: US 9,834,336 B1
(45) Date of Patent: Dec. 5, 2017

(54) DECORATIVE DIVIDER FOR PAN

(71) Applicant: Marvin Bowen, White Plains, NY (US)

(72) Inventor: Marvin Bowen, White Plains, NY (US)

( * ) Notice: Subject to any disclaimer, the term of this patent is extended or adjusted under 35 U.S.C. 154(b) by 0 days.

(21) Appl. No.: 15/211,630

(22) Filed: Jul. 15, 2016

Related U.S. Application Data

(60) Provisional application No. 62/231,747, filed on Jul. 16, 2015.

(51) Int. Cl.
*B65D 25/04* (2006.01)
*A47J 36/16* (2006.01)
*B65D 43/02* (2006.01)

(52) U.S. Cl.
CPC ..... *B65D 25/04* (2013.01); *A47J 36/16* (2013.01); *B65D 43/02* (2013.01)

(58) Field of Classification Search
CPC ..... B65D 43/08; B65D 25/04
USPC ..... 220/523, 524, 525, 529, 573.1, 912
See application file for complete search history.

(56) References Cited

U.S. PATENT DOCUMENTS 2,335,016 A * 11/1943 Lorenzen ..... A61J 1/03 206/538
3,381,875 A * 5/1968 Tunick ..... B65D 3/24 220/524
4,955,503 A * 9/1990 Propes ..... A47G 19/2266 220/526
8,317,040 B2 * 11/2012 Lanning ..... A47B 88/90 108/60
8,701,912 B2 * 4/2014 Carnevali ..... B63B 49/00 206/315.11
8,820,522 B2 * 9/2014 Quarry ..... A45C 5/04 116/63 C
2015/0041470 A1 * 2/2015 Huffer ..... B65D 17/163 220/270
2015/0122820 A1 * 5/2015 Whitley ..... A45C 11/16 220/528

OTHER PUBLICATIONS

Winco. "Winco SPFD2 2-1/2-Inch Divider Food Pan, Full Size." Amazon.com: Chafing Dish: Home & Kitchen. N.p., Oct. 7, 2007. Web. <https://www.amazon.com/Winco-SPFD2-2-Inch-Divider-Food/dp/B003HER6DK/187-8372996-7925224?ie=UTF8&keywords=pan+dividers&qid=1461713383&ref_=sr_1_19&s=home-garden&sr=1-19>.

* cited by examiner

*Primary Examiner* — King M Chu
(74) *Attorney, Agent, or Firm* — Leason Ellis LLP

(57) ABSTRACT

A divider for dividing a hollow interior of a pan into first and second sections includes a main body that has a bottom face, first and second end faces and a top face. The main body is configured to stand upright in the hollow interior of the pan with the bottom face for seating against a floor of the pan and first and second end faces for sealing against opposing side walls of the pan. The divider includes first and second foldable covers for covering the first and second sections. The first cover is coupled to the top face along an inner edge thereof and the second cover is coupled to the top face along an inner edge thereof. First and second coupling tabs protrude outwardly from the main body and are configured to engage top edges of the opposing side walls of the pan.

12 Claims, 7 Drawing Sheets

DECORATIVE DIVIDER FOR PAN

CROSS-REFERENCE TO RELATED APPLICATION

The present invention claims priority to U.S. patent application Ser. No. 62/231,747, filed Jul. 16, 2015, which is hereby incorporated by reference in its entirety.

BACKGROUND

Pans come in many different shapes and are used for many different purposes including use during cooking of food as well as being used to hold food that has been cooked. For example, one type of pan is a serving tray or pan that is intended to hold food that is being served. Serving pans are often used to serve many people at an event, such as a holiday party, birthday party, wedding, etc. In order to hold heat or cold within the pan and/or protect the food, the pan is typically covered. Many times, serving pans are too big for serving a single food and therefore, when the food is placed in the serving pan, there is an excessive amount of empty space and the food can look underwhelming due to the size of the pan. It would therefore be desirable to be able to divide the pan so that more than one food can be placed in the pan in a separated manner.

SUMMARY

A divider for dividing a hollow interior of a pan into first and second sections includes a main body that has a bottom face, first and second end faces and a top face. The main body is configured to stand upright in the hollow interior of the pan with the bottom face for seating against a floor of the pan and first and second end faces for sealing against opposing side walls of the pan. The divider includes first and second foldable covers for covering the first and second sections. The first cover is coupled to the top face along an inner edge thereof and the second cover is coupled to the top face along an inner edge thereof. The first and second covers can be sheets of metal foil. First and second coupling tabs protrude outwardly from the main body and are configured to engage top edges of the opposing side walls of the pan.

BRIEF DESCRIPTION OF THE DRAWING FIGURES

DETAILED DESCRIPTION OF CERTAIN EMBODIMENTS

Figure 1:
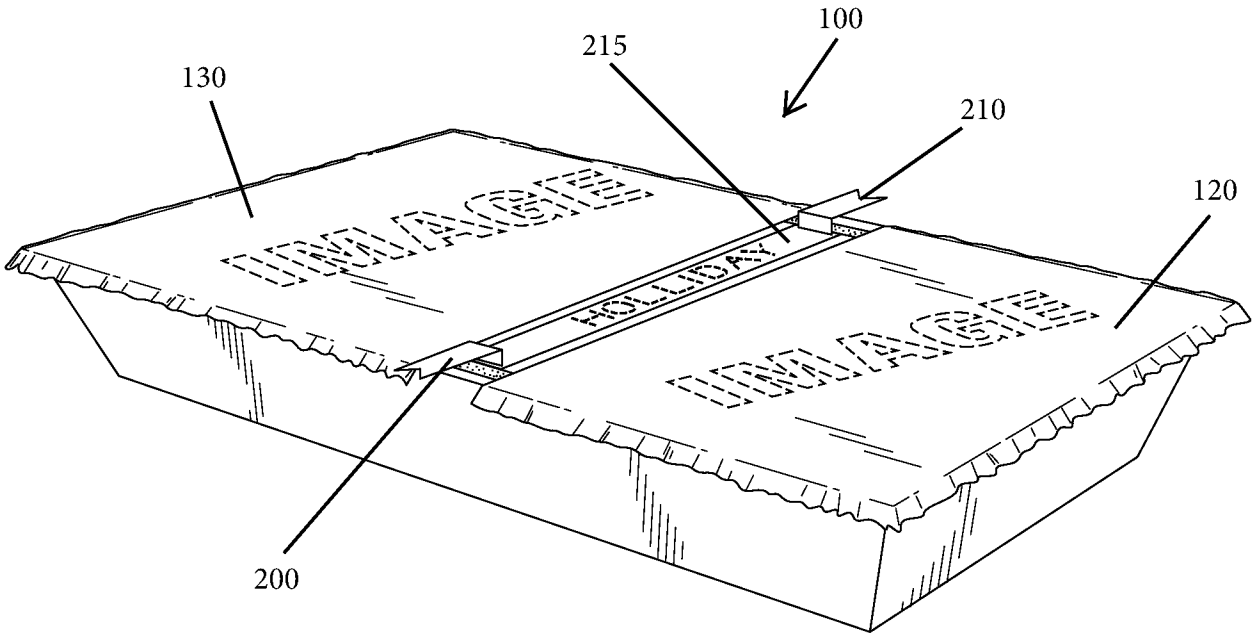
FIG. 1 is a perspective view of a decorative divider inserted within a pan with a pair of covers shown in a crimped position completely covering the pan.

FIGS. 1-4 illustrate a decorative divider 100 according to one embodiment for use with a pan 10 of a complementary size and shape. Pan 10 is typically a metal pan that has a floor 11 and a plurality of side walls 20 with an open top. A top edge 22 of each side wall 20 traditionally has a bent rim, lip, or the like. The decorative divider 100 is particularly intended for use with pan 10 that have a rectangular shape or a square shape.

The decorative divider 100 is configured to be received and maintained in an upright position within the hollow interior of the pan 10 so as to divide the hollow interior of the pan 10 into a first section and an adjacent second section. Each of the first and second sections is intended to hold food and thus, two different types of food can be conveniently and effectively separated from one another within the pan. Separation of food prevents unwanted mixing of food and makes it easier for a person to take desired food from one of the compartments without commingling concerns and also makes it easier for refilling of the food. It will also be appreciated that two or more dividers 100 can be used in the pan 10 to separate the interior thereof into more than two compartments.

Figure 2:
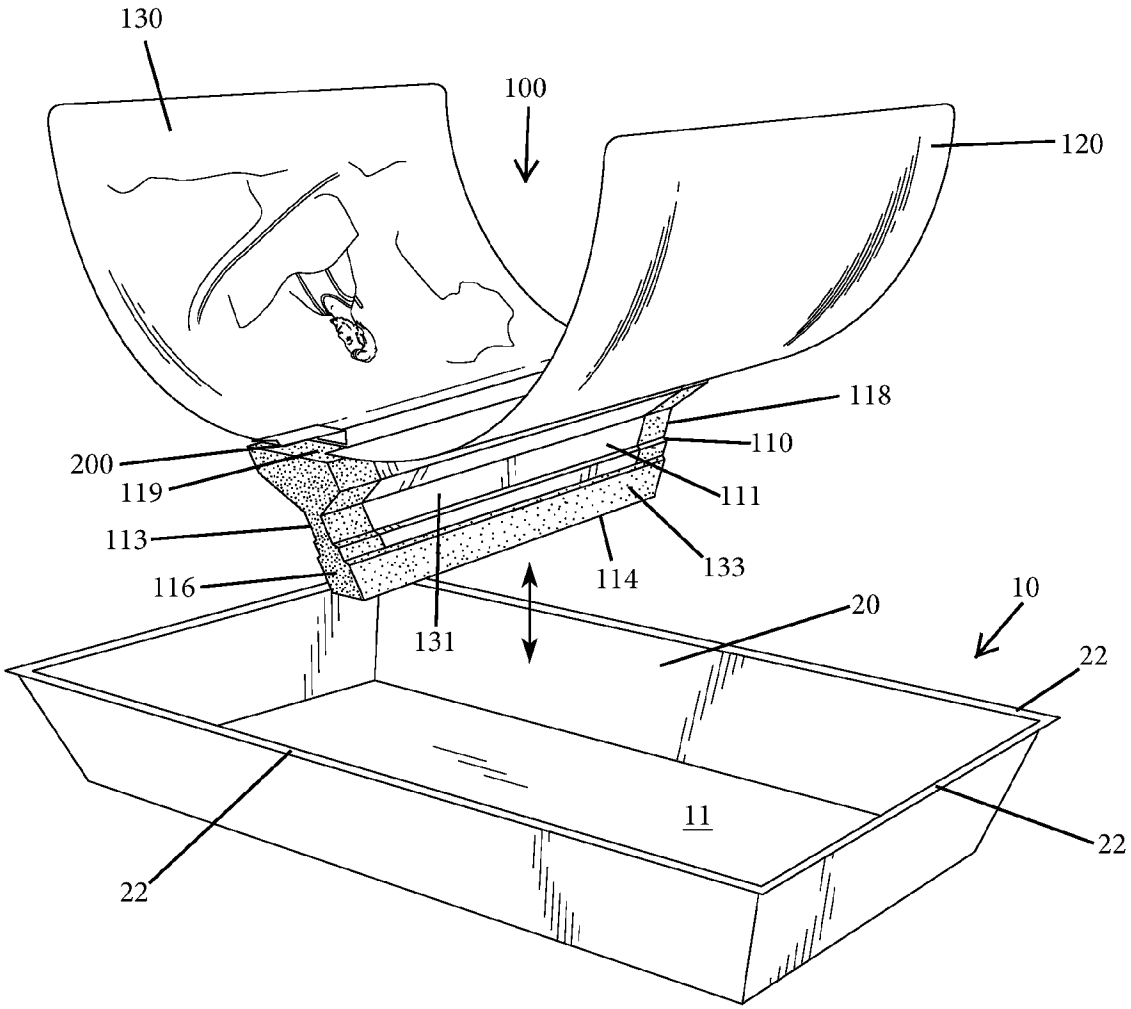
FIG. 2 is an exploded perspective view showing the decorative divider prior to insertion within the pan.
Figure 3:
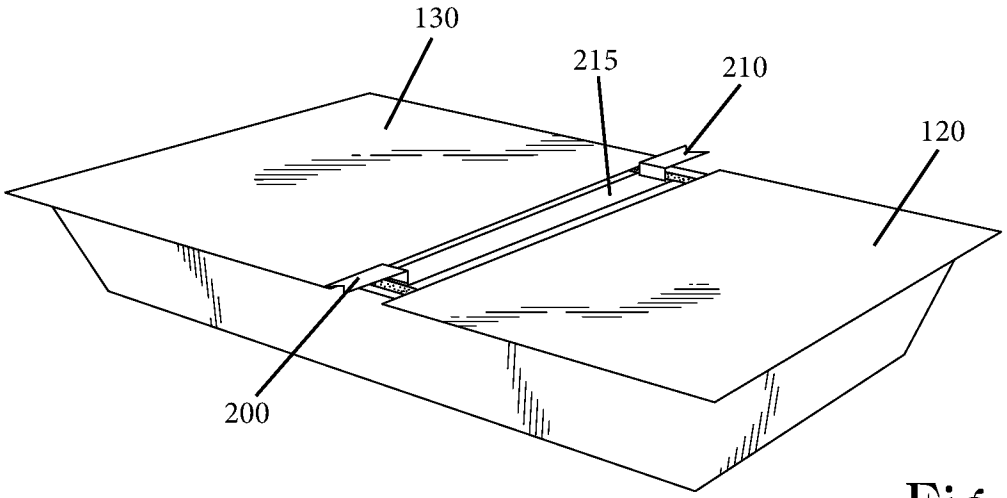
FIG. 3 is a perspective view of the decorative divider inserted in the pan with the pair of covers disposed over the pan but not yet crimped.
Figure 4:
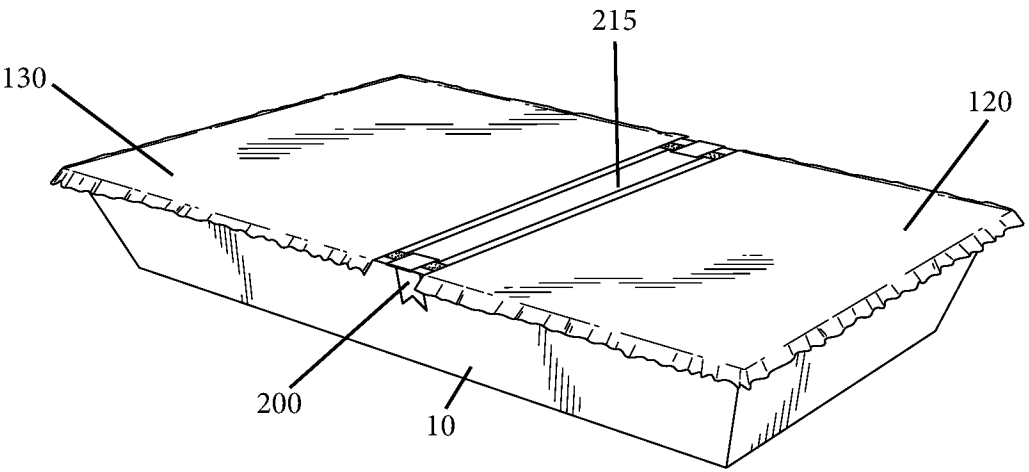
FIG. 4 is a perspective view of the decorative divider inserted in the pan with the pair of covers and center tabs being crimped to hold and maintain the divider in an upright position.

FIG. 2 best shows the construction of the decorative divider 100. The decorative divider 100 is formed of a base 110 that is intended to be inserted into and seat against the floor and side walls of the pan 10 and preferably, seals against the pan 10. The decorative divider 100 also includes a first cover 120 for covering the partitioned first section of the pan 10 and a second cover 130 for covering the partitioned second section of pan 10. The decorative divider 100 also preferably includes center tabs 200, 210 that act to releasably couple the decorative divider 100 to the pan 10 to allow the divider 100 to remain upright.

The base 110 of the decorative divider 100 is thus configured to seat against and preferably seal against the floor and side walls of the pan 10. The base 110 is formed of a body 112 that has a first face 111 and an opposing second face 113 and a bottom edge 114 and a pair of opposing end walls 116, 118. The base 110 also as a top face/surface 119 which lies between the first and second faces 111, 113. The top face 119 is preferably a planar surface as described below.

The center tabs 200, 210 are disposed along the respective opposing end walls 116, 118. The center tabs 200, 210 are constructed, at least in one embodiment, such that each of the tabs 200, 210 extends beyond one of the opposing end walls 116, 118 to allow the tab 200, 210 to engage and be coupled to the upper edge 22 of the opposing side walls 20. For example, the tab 200, 210 is formed of a material, such as a metal, that can be crimped so as to releasably attach the divider 100 to the pan 10. As shown in the figures, the tabs 200, 210 can be part formed as part of a decorative ribbon 215 that extends across the top face 119. The decorative ribbon can be formed in a color that is different than the surrounding parts of the divider 100. The ribbon 215 can thus be part of the decorative appearance of the divider 100. The ribbon can also contain indicia, such as text and/or graphics or images.

The decorative ribbon 215, including the tabs 200, 210 located at the free ends thereof, can be formed of a metal foil or thin metal plate that is capable of being crimped by hand at least at the tabs 200, 210. The user can simply fold down the tabs 200, 210 and then bend the tabs 200, 210 inward around the top edge 22 (which can be in rim or lip form), thereby securely attaching the divider 100 to the pan 10 so that the divider 100 assumes and maintains an upright position.

The tabs 200, 210 can also be in the form of plastic clips that can engage and lock with the rim (upper edge 22) of the side wall 20. The plastic clips can have a U-shaped structure that has an opening into which the rim of the side wall 20 is inserted. A friction fit can be formed between the clip and the rim/lip.

Figure 10A:
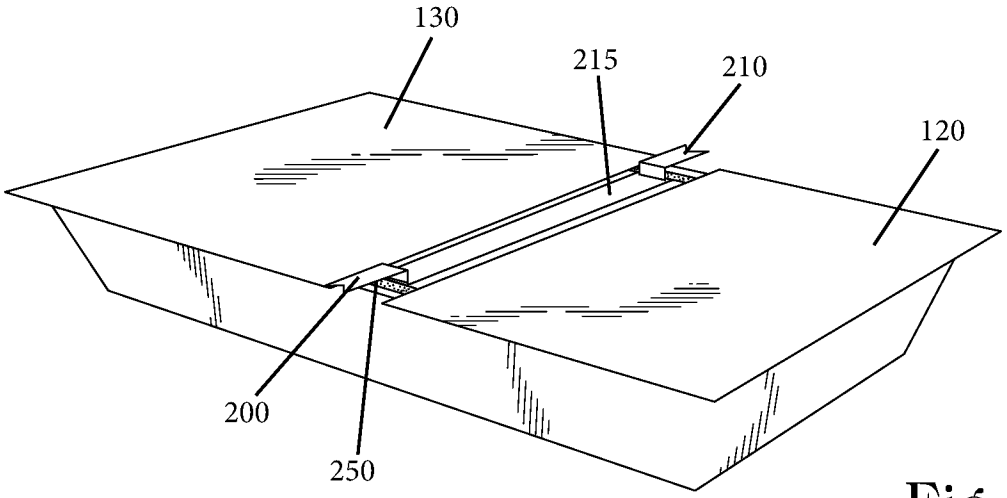
FIG. 10A is a perspective view of the decorative divider inserted in the pan with an adhesive on the underside of the coupling tabs.
Figure 10B:
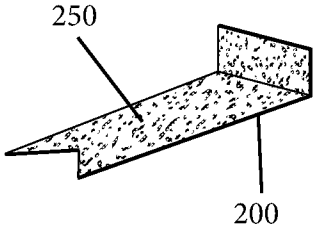
FIG. 10B is perspective view of the underside of one coupling tab showing the adhesive.

The bottom edge 114 seats against the floor or the pan, while the end walls 116, 118 seat against the side walls of the pan 10. Since most pans 10 have inwardly tapered side walls (i.e., the side walls taper at least slightly inward toward the floor), the end walls 116, 118 have complementary tapered constructions to allow the divider 100 to fit the pan 10. It will be appreciated that other means can be used to secure the divider to the rim. For example, the decorative ribbon can be formed of a paper product, such as cardboard, and the tabs 200, 210 can include adhesive 250 (e.g., double sided adhesive pads)(FIGS. 10A and 10B) that permits the tabs 200, 210 to be secured to the side walls 20. When double sided adhesive pads 250 are used, protective covers (release layers) are initially provided over the pads. When the divider 100 is ready for use, the user removes the release layers from the adhesive pads and then folds over the tabs 200, 210 with the adhesive pads facing the pan. The user then presses the adhesive pads against the pan to secure the tabs 200, 210 to the pan 10. It will be appreciated that the adhesive selected is of a type that allows the tabs 200, 210 to be removed after use without marring the pan 10. It will be understood that the adhesive is of a type that does not mar the pan and the tab containing the adhesive can be released from the pan. Also, the adhesive pad can be formed on a thin metal foil to allow both crimping and adhesive bonding to secure the tab to the pan's edge.

The height of the divider 100 is selected so that when the divider 100 is fully inserted into the pan 10, the top surface 119 and center tabs 200, 210 to be preferably at or above the height of the top edges 22 of the side walls 20. However, the top surface 119 and the center tabs 200, 210 can be located slightly below the top edges 22 of the side walls 20.

The width of the top face 119 is selected so as to allow an inner edge of the first cover 120 to seat and be coupled thereto; an inner edge of the second cover 130 to seat and be coupled thereto; and the center tabs 200, 210 to seat and be coupled thereto. The inner edges of the first and second covers 120, 130 can be secured to the top face 119 or the ribbon attached therealong using conventional techniques, including the use of mechanical fasteners or adhesive (glue). For example, the inner edge of the first and second covers 120, 130 can contain adhesive that secured the first and second covers 120, 130 to the top face 119 adjacent the ribbon. The ribbon can be secured also to the top face 119 using conventional techniques, such as mechanical fasteners or adhesive (glue).

The base 110 can be formed of a single material or can be formed of two or more materials. For example, the base 100 can be formed of a single solid material, such as metal or plastic or wood or other suitable material. FIG. 2 shows another embodiment in which the base 110 is formed of two materials, namely, the base 110 includes a center portion 131 formed of one material and an outer (pan contacting) portion 133 formed of another material. The center portion 131 can be formed of the materials listed above and in one embodiment, the outer portion 133 is formed of an elastic, compressible material. The outer portion 133 is designed to seat against the pan and can compress as it is being inserted into the pan 10 to provide a secure fit. The outer portion 133 is thus formed on three sides namely, the bottom and two ends of the divider to seat against the floor and two sides of the pan 10.

For example, as the divider 100 is inserted into the pan 10, the ends of the outer portion 133 encounter the side walls 20 of the pan 10 and can compress. The outer portion 133 can be attached to the center portion 131 using conventional techniques, including overmolding or use of an adhesive.

Figure 7:
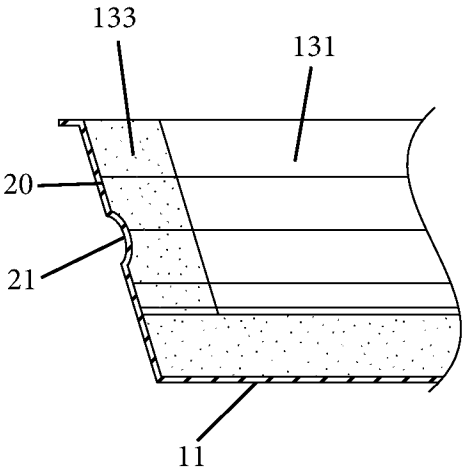
FIG. 7 is a cross-sectional view of a decorative divider seated against an integral crimp formed along a side wall of the pan.

In one embodiment, the outer portion 133 is formed of a suitable elastic material, such as silicone, or can be formed of a suitable foam material or sponge material (cellulose fibers). When the outer portion 133 is formed of a sponge material, it not only can seat against the pan but in the event that there is a small amount of liquid in the bottom of the pan, the sponge material can absorb it and prevent it from entering the other side. FIG. 7 shows pan 10 according to one embodiment having a crimped section 21 formed along the side wall 20. It will be appreciated that the opposing side walls 20 can each include a crimped section 21. The crimped section 21 protrudes inwardly and therefore, when the divider 100 is inserted, the crimped section 21 compresses the elastic outer portion 133 of the divider 100 as shown in FIG. 7. The seating of the crimped section 21 within the elastic outer portion 133 serves as an additional means for securing the divider 100 in place within the hollow interior of the pan 10.

In other embodiment, the outer portion 133 can be formed of a layer that includes super absorbent polymer (SAP) that as is known, will swell when exposed to a fluid.

Figure 11:
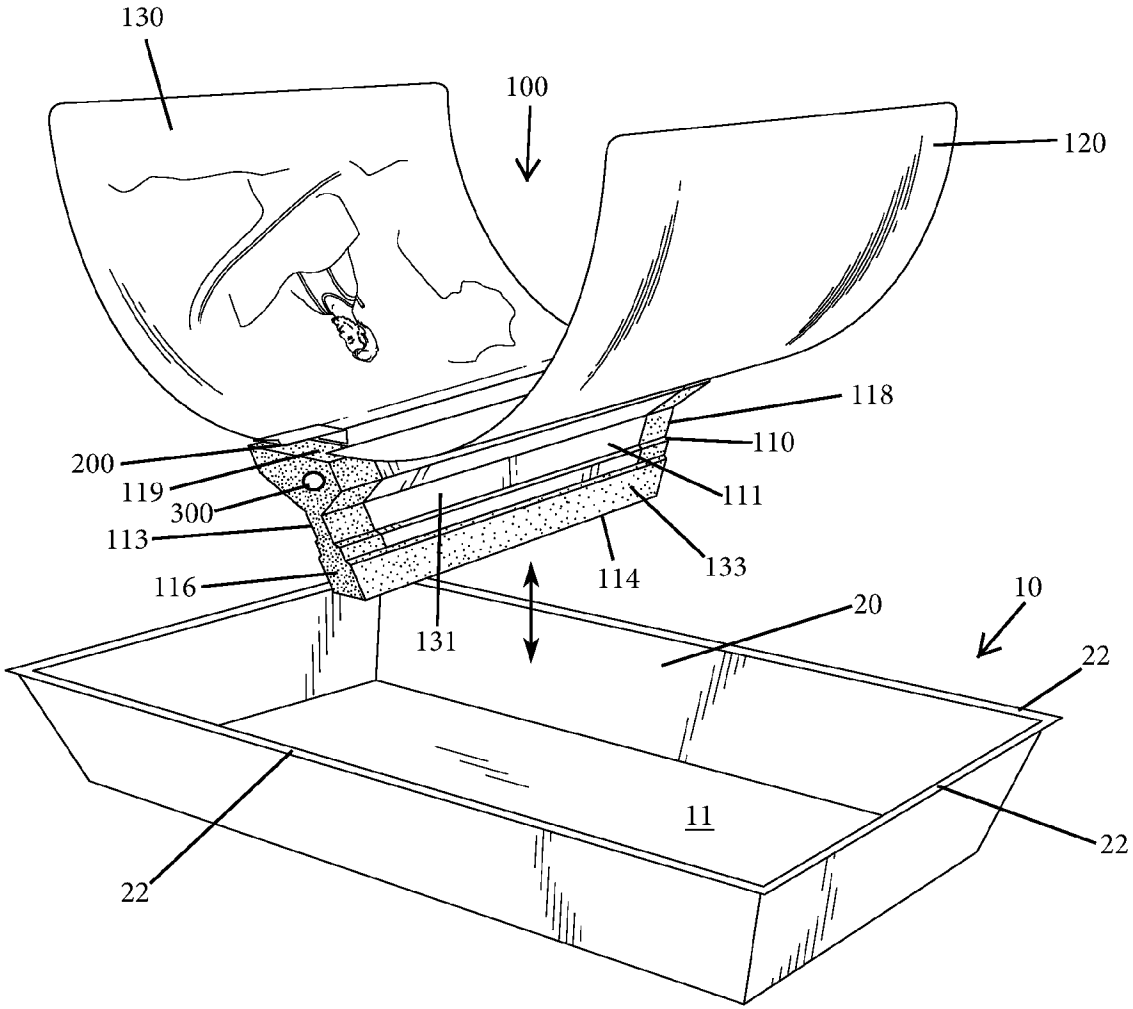
FIG. 11 is an exploded perspective view showing the decorative divider prior to insertion within the pan showing at least one magnet as part of the divider.

In yet another embodiment, shown in FIG. 11, one or more magnets 300 can be used to couple the divider 100 to the pan 10. For example, a magnet 300 can be provided along at least one of the bottom 114 and end walls 116, 118 of the divider 100. The magnets 300 are preferably countersunk within the divider body 110 so as to not protrude from the outer surface of the divider. For example, when the outer portion of the body 110 comprises a sponge material, the sponge material can have local recessed areas in which the magnets are set and secured. The magnets can be secured to the sponge material using conventional techniques, such as an adhesive or the like. The magnets 300 provide a means for releasably attaching the divider 100 to the pan 10. There can be one or more magnets along the bottom face of the divider 100 and also one or more magnets along each of the end walls. The magnets can come in any number of different shapes (e.g., disc shaped) and sizes.

Figure 6:
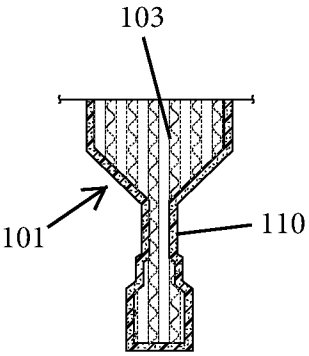
FIG. 6 is a cross-sectional view of a base portion of a decorative divider according to one embodiment.

FIG. 6 shows a divider 101 according to another embodiment. In this case, the divider 101 is weighted with a material 103 that disposed within the divider body 110. For example, the divider body 110 can be hollow and a material that adds weight to the body 110 is disposed within the hollow body 110. Any number of different safe materials can be used such as rice or sand.

Figure 9:
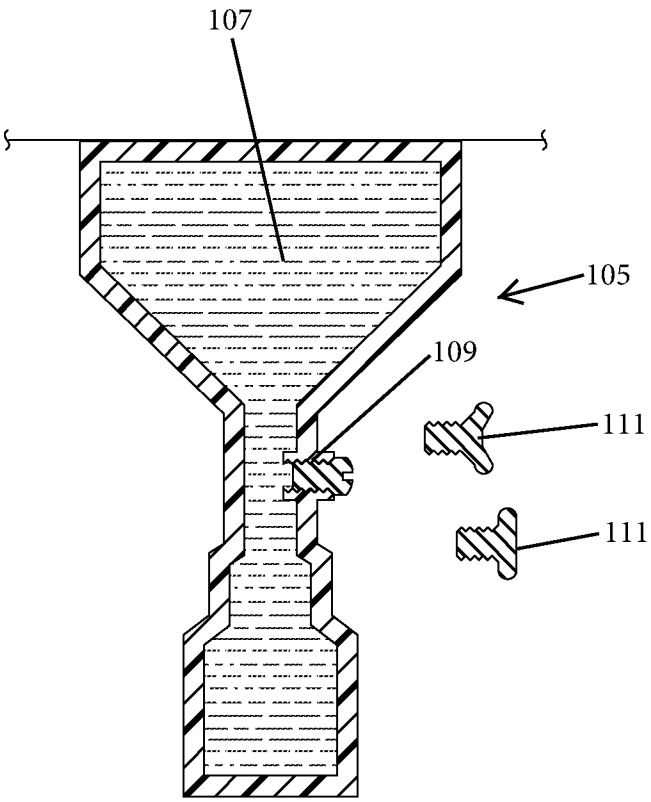
FIG. 9 is a cross-sectional view of a base portion of a decorative divider according to another embodiment.
Figure 8:
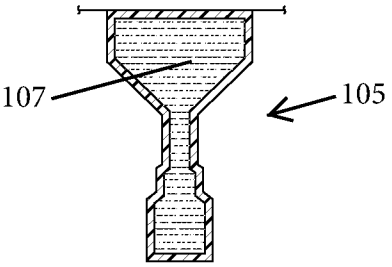
FIG. 8 is a cross-sectional view of a base portion of a decorative divider according to another embodiment.

FIGS. 8-9 show yet another embodiment of a divider 105. The divider 105 is similar to the divider 100, 101. The divider 105 is also a hollow body and is filled with water 107 to weight down the divider 105. As shown in FIG. 9, the divider body 105 includes an opening 109 that permits the water to be added into the divider body 105 and also permits the water to be drained from the hollow body. A plug 111 can be used to close off the opening 109. FIG. 8 shows a variety of different shaped plugs 111 that can be used. The water weights down the divider body to ensure that the divider 105 remains in place.

In one embodiment, the first and second covers 120, 130 are formed of a crimpable material that allows the sealing of the covers 120, 130 to the pan 10 so as to cover and enclose the hollow interior of the pan 10. For example, the first and second covers 120, 130 comprise a metal foil that can be easily folded and crimped.

Figure 5:
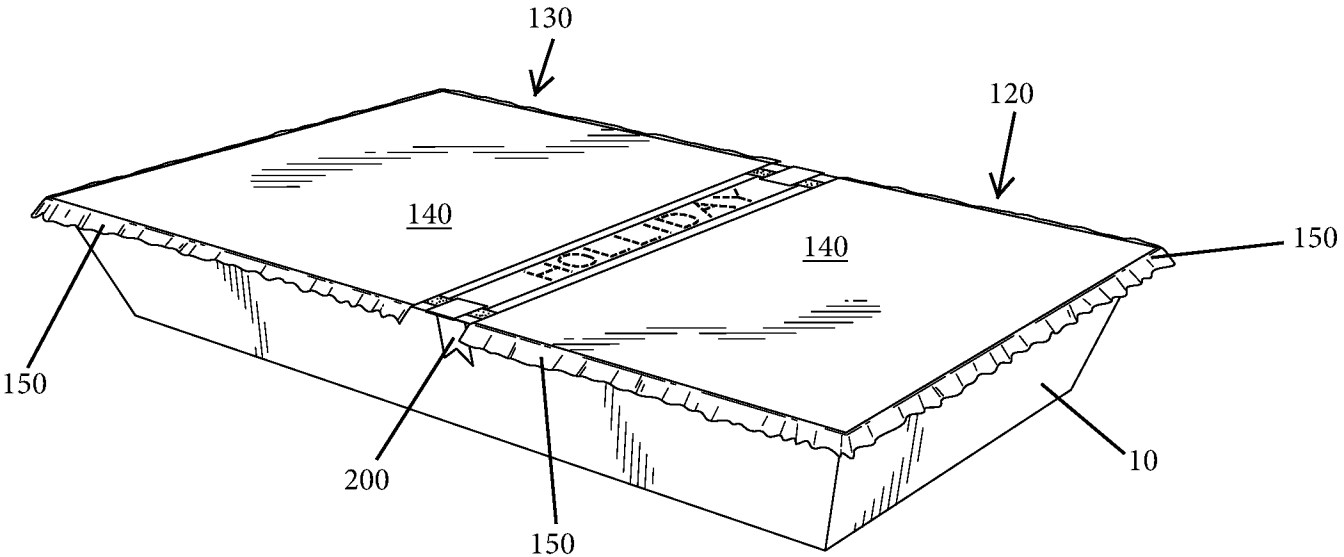
FIG. 5 is a perspective view of the decorative divider inserted in the pan with a pair of covers of an alternative embodiment.

In another embodiment, as shown in FIG. 5, the first and second covers 120, 130 can be formed of two different types of material. In particular, each of the first and second covers 120, 130 is defined by a core 140 and peripheral edging 150. The core 140 is designed to sit against the top edge 22 of the side walls 20 but not be securely attached (coupled) thereto. The peripheral edging 150 is designed to be coupled to the top edge 22. For example, the peripheral edging 150 can be in the form of a crimpable material, such as metal foil. In this embodiment, the covers 120, 130 seat on the upper edge of the side walls 20 of the pan 10 and then the foil which makes up the peripheral edging 150 is folded down and underneath the rim/lip (upper edge 22) of the side walls 20.

The covers 120, 130 also can be formed to have different colors and also can include printed text and/or images. Any number of different printing and/or embossing techniques can be used to impart the text and/or images onto the outer surface of the covers 120, 130. For a birthday, the text can be in the form of "Happy Birthday" and the images can be in the form of balloons, etc.

FIGS. 1-4 show how the decorative divider 100 is used with pan 10. Prior to placing food in the pan 10, the divider 100 is set and anchored to the pan 10 by inserting the divider 100 into the hollow interior of the pan 10. Initially, the first and second covers 120, 130 can be folded upward to reveal the hollow interior of the pan 10 and permit the food to be added after the divider 100 is positioned and anchored in place. After inserting the divider 100, the divider is positioned so that it assumes preferably a snug fit between the side walls 20 of the pan 10 and against a floor thereof. Then the center tabs 200, 210 are manipulated as by folded over to form a crimp type connection with the side walls 20 of the pan 10. Crimping of the center tabs 200, 210 serve to secure the divider 100 to the pan 10.

Once the divider 100 is secured to the pan 10, the food can be placed into the two compartments that are defined in the pan 10. After placement of the food, the first and second covers 120, 130 can then be lowered and then the covers 120, 130 can be secured themselves to the side walls and end walls of the pan 10 by folding over (crimping) the peripheral edges of the covers 120, 130 relative to the upper edges 22 (rim/lip) of the side walls and end wall. This crimping of the peripheral edges of the covers 120, 130 also provides additional attachment points between the divider 100 and the pan 10. In other embodiment, the adhesive pad 250 is pressed onto the pan and/or magnets attach to the pan.

When the food is ready to be accessed, the user simply folds up one or more of the covers 120, 130 to reveal the food.

It will therefore be appreciated that the present invention is directed to a removable divider that is a kind of separator that acts as a barrier that keeps food(s) from entering another space or compartment that is divided by the divider. Preferably, any fluid or liquid from one separated side will not enter the other separated space. The present divider is not only a divider but also for displaying events and also acts as a decoration. The divider can be made of different materials, such as a thick metal foil, thick cardboard material and rigid plastics. The divider is an elongated product with slanted edges pointing in different direction to contour the shape of disposable foil pans shape.

A long strip of soft stretchable non-toxic sponge with suction ability lined from one end under the bottom to the other end. This is more ideal for food with little or a lot of liquids or fluids. As mentioned herein, a magnetic strip can be placed at least on the bottom face and optional along the ends of the divider. The magnetic strip can run on the bottom from one end to the other end. The first and second coupling tabs can be made of thicker foil material that stays folded till removed or unfolded. The divider can also be coated with a high heat plastic. As mentioned, the divider 100 is a decorated object used to display at events, such as, birthdays, weddings, barbeques, parties, get together, gatherings, etc. The displaying portion of the divider is on top that will display events or activity with glowing layered material designs and not limited to cartoon characters, super hero action hero, wrestling characters, racing cars, flowers, landscapes, sport themes, even themes, such as birthday themes and holiday themes, such as Christmas, Halloween, July $4^{th}$, New Year's Eve, etc. The decorative indicia can be directly formed on the first and second covers or can be applied thereto as in the case of it being a thin plastic decorative film that is applied to the covers.

What is claimed is:

1. A divider for dividing a hollow interior of a pan into first and second sections comprising:

a main body that has a bottom face, first and second end faces and a top face, the main body configured to stand upright in the hollow interior of the pan with the bottom face for seating against a floor of the pan and the first and second end faces for sealing against opposing side walls of the pan;

first and second foldable covers for covering the first and second sections, the first cover being coupled to the top face along an inner edge thereof, the second cover being coupled to the top face along an inner edge thereof; and first and second coupling tabs protruding outwardly from the main body and configured to engage top edges of the opposing side walls of the pan;

wherein the main body is formed of an inner core formed of a first material and an outer portion that extends around a periphery of the inner core, the outer portion being formed of a second material;

wherein the inner core is formed of a rigid material and the outer portion is formed of an elastic material.

2. The divider of claim 1, wherein the first and second end faces taper inwardly in a direction toward the bottom face.

3. The divider of claim 1, wherein the outer portion is formed of a sponge material.

4. The divider of claim 1, wherein the top face includes an elongated ribbon extending longitudinally along the top face, the first and second coupling tabs being disposed at distal ends of the ribbon.

5. The divider of claim 1, wherein main body includes at least one magnet along an outer surface thereof.

6. The divider of claim 1, wherein the first and second coupling tabs comprises crimpable metal tabs.

7. The divider of claim 1, wherein each of the first and second foldable covers comprises metal foil.

8. The divider of claim 1, wherein the first and second foldable covers includes decorative indicia.

9. The divider of claim 1, wherein an underside of each of the first and second coupling tabs includes an adhesive pad.

10. A divider for dividing a hollow interior of a pan into first and second sections comprising:

a main body that has a bottom face, first and second end faces and a top face, the main body configured to stand upright in the hollow interior of the pan with the bottom face for seating against a floor of the pan and first and second end faces for sealing against opposing side walls of the pan;

first and second foldable covers for covering the first and second sections, the first cover being coupled to the top face along an inner edge thereof, the second cover being coupled to the top face along an inner edge thereof; and first and second coupling tabs protruding outwardly from the main body and configured to engage top edges of the opposing side walls of the pan;

wherein the main body is hollow and filled with a weighting material.

11. The divider of claim 10, wherein the weighting material comprises water.

12. A divider for dividing a hollow interior of a pan into first and second sections comprising:

a main body that has a bottom face, first and second end faces and a top face, the main body configured to stand upright in the hollow interior of the pan with the bottom face for seating against a floor of the pan and first and second end faces for sealing against opposing side walls of the pan;

first and second foldable covers for covering the first and second sections, the first cover being coupled to the top face along an inner edge thereof, the second cover being coupled to the top face along an inner edge thereof; and first and second coupling tabs protruding outwardly from the main body and configured to engage top edges of the opposing side walls of the pan;

wherein each of the first and second foldable covers comprises a center core formed of cardboard and peripheral edging that extends about exposed edges of the cardboard center core, the peripheral edging comprising crimpable metal foil.

* * * * *